US006294875B1

(12) United States Patent
Kurata et al.

(10) Patent No.: US 6,294,875 B1
(45) Date of Patent: Sep. 25, 2001

(54) METHOD OF DRIVING AC PLASMA DISPLAY PANEL

(75) Inventors: Takatsugu Kurata; Shinji Masuda; Makoto Kawachi; Yukiharu Ito; Takao Wakitani, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/487,837

(22) Filed: Jan. 19, 2000

(30) Foreign Application Priority Data

Jan. 22, 1999 (JP) ..... 11-013857
Feb. 22, 1999 (JP) ..... 11-042549

(51) Int. Cl.[7] ..... G09G 3/10

(52) U.S. Cl. ..... 315/169.1; 315/169.3; 315/169.4; 315/169.2; 345/60; 345/148

(58) Field of Search ..... 315/169.1, 169.2, 315/169.3, 169.4; 345/60, 148

(56) References Cited

U.S. PATENT DOCUMENTS 5,317,334 * 5/1994 Sano ..... 345/148
5,745,086 4/1998 Weber .
5,835,072 * 11/1998 Kanazawa ..... 345/60
5,854,540 * 12/1998 Masumoto et al. ..... 315/169.1
6,198,476 * 3/2001 Hong et al. ..... 315/169.4

FOREIGN PATENT DOCUMENTS 0 657 861 6/1995 (EP) .
0 855 692 7/1998 (EP) .

* cited by examiner

*Primary Examiner*—Don Wong
*Assistant Examiner*—Jimmy Vu
(74) *Attorney, Agent, or Firm*—Merchant & Gould P.C.

(57) ABSTRACT

A method of driving an AC plasma display panel for carrying out gray-scale display using a structure in which each field consists of a plurality of subfields, each of which includes an initialization period, a write period, and a sustain period. At least in one predetermined subfield out of the plurality of subfields, at least a part of a sustain operation in the sustain period and at least a part of an initialization operation in the initialization period in a subsequent subfield are carried out at the same time. The visibility of black is improved considerably and the contrast can be enhanced greatly.

7 Claims, 6 Drawing Sheets

METHOD OF DRIVING AC PLASMA DISPLAY PANEL

FIELD OF THE INVENTION

The present invention relates to a method of driving an AC plasma display panel used for image display in a television receiver, a computer monitor, or the like.

BACKGROUND OF THE INVENTION

A partial perspective view of an AC plasma display panel (hereinafter referred to as a "panel") is shown in FIG. 4. As shown in FIG. 4, a scanning electrode 4 and a sustain electrode 5 that are covered with a dielectric layer 2 and a protective film 3 are provided on a first glass substrate 1 in parallel with each other as a pair. On a second glass substrate 6, a plurality of data electrodes 8 covered with an insulator layer 7 are provided. Separation walls 9 are provided in parallel to the data electrodes 8 on the insulator layer 7 between every two of the data electrodes 8. Phosphors 10 are formed on the surface of the insulator layer 7 and on both side faces of each separation wall 9. The first glass substrate 1 and the second glass substrate 6 are positioned opposing each other with discharge spaces 11 being sandwiched therebetween so that the scanning electrodes 4 and the sustain electrodes 5 are orthogonal to the data electrodes 8. In the discharge spaces 11, xenon and at least one selected from helium, neon, and argon are filled as discharge gases. The discharge spaces at the intersections of the data electrodes 8 and pairs of scanning electrode 4 and sustain electrode 5 form respective discharge cells 12.

FIG. 5 is a diagram showing the electrode array in this panel. As shown in FIG. 5, this electrode array has a matrix structure formed of m columns×n rows. In the column direction, m columns of data electrodes $D_1$–$D_m$ are arranged, and n rows of scanning electrodes $SCN_1$–$SCN_n$ and sustain electrodes $SUS_1$–$SUS_n$ are arranged in the row direction. The discharge cell 12 shown in FIG. 4 corresponds to the region shown in FIG. 5.

FIG. 6 is a diagram showing the timing chart of an operation driving waveform in a conventional driving method for driving this panel. This driving method is used for displaying 256 shades of gray. One field consists of eight subfields. This driving method is described with reference to FIGS. 4 to 6 as follows.

As shown in FIG. 6, each of first to eighth subfields includes an initialization period, a write period, a sustain period, and an erase period. First, the description is directed to the operation in the first subfield.

As shown in FIG. 6, all the data electrodes $D_1$–$D_m$ and all the sustain electrodes $SUS_1$–$SUS_n$ are maintained at a voltage of 0 in an initialization operation in a first part of the initialization period. To all the scanning electrodes $SCN_1$–$SCN_n$, a lamp voltage is applied, which increases gradually from a voltage of VP toward a voltage of Vr. The voltages of Vp and Vr provide the scanning electrodes $SCN_1$–$SCN_n$ with voltages below and beyond the discharge starting voltage with respect to the sustain electrodes $SUS_1$–$SUS_n$, respectively. During the lamp voltage increases, a first weak initialization discharge occurs in all the discharge cells 12 from the scanning electrodes $SCN_1$–$SCN_n$ to the data electrodes $D_1$–$D_m$ and the sustain electrodes $SUS_1$–$D_n$, respectively. Due to the first weak initialization discharge, a negative wall voltage is stored in the regions of the protective film 3 surface that are positioned on the scanning electrodes $SCN_1$–$SCN_n$ (hereinafter this terminology is described simply as "at the surface of the protective film 3 on the scanning electrodes $SCN_1$–$SCN_n$"). At the same time, a positive wall voltage is stored at the surface of insulator layer 7 on the data electrodes $D_1$–$D_m$ and at the surface of the protective film 3 on the sustain electrodes $SUS_1$–$SUS_n$.

In the initialization operation in a second part of the initialization period, all the sustain electrodes $SUS_1$–$SUS_n$ are maintained at a positive voltage of Vh. To all the scanning electrodes $SCN_1$–$SCN_n$, a lamp voltage is applied, which decreases gradually from a voltage of Vq toward a voltage of 0. The voltages of Vq and 0 provide the scanning electrodes $SCN_1$–$SCN_n$with voltages below and beyond the discharge starting voltage with respect to the sustain electrodes $SUS_1$–$SUS_n$, respectively. During the lamp voltage decreases, a second weak initialization discharge occurs again in all the discharge cells 12 from the sustain electrodes $SUS_1$–$SUS_n$ to the scanning electrodes $SCN_1$–$SCN_n$. The second weak initialization discharge weakens the negative wall voltage at the surface of the protective film 3 on the scanning electrodes $SCN_1$–$SCN_n$ and the positive wall voltage at the surface of the protective film 3 on the sustain electrodes $SUS_1$–$SUS_n$. A weak discharge also occurs between the data electrodes $D_1$–$D_m$ and the scanning electrodes $SCN_1$–$SCN_n$. Consequently, the positive wall voltage at the surface of the insulator layer 7 on the data electrodes $D_1$–$D_m$ is adjusted to a value suitable for a write operation.

Thus, the initialization operation in the initialization period is completed.

In the write operation in the subsequent write period, initially all the scanning electrodes $SCN_1$–$SCN_n$ are maintained at a voltage of Vs. Then, a positive write pulse voltage of +Vw is applied to a designated data electrode $D_j$ (j indicates one or more integers of 1 to m) that is selected from the data electrodes $D_1$–$D_m$ and corresponds to a discharge cell 12 to be operated so as to emit light in the first line and at the same time a scan pulse voltage of 0 is applied to the scanning electrode $SCN_1$ of the first line. In this state, the voltage between the surface of the insulator layer 7 and the surface of the protective film 3 on the scanning electrode $SCN_1$ at the intersection of the designated data electrode $D_j$ and the scanning electrode $SCN_1$ is calculated by adding the positive wall voltage at the surface of the insulator layer 7 on the data electrodes $D_1$–$D_m$ to the write pulse voltage of +Vw. Therefore, at this intersection, a write discharge occurs be tween the designated data electrode $D_j$ and the scanning electrode $SCN_1$ and between the sustain electrode $SUS_1$ and the scanning electrode $SCN_1$. Thus, at this intersection, a positive wall voltage is stored at the surface of the protective film 3 on the scanning electrode $SCN_1$, a negative wall voltage at the surface of the protective film 3 on the sustain electrode $SUS_1$, and a negative wall voltage at the surface of the insulator layer 7 on the data electrode $D_j$.

Then, a positive write pulse voltage of +Vw is applied to a designated data electrode $D_j$ that is selected from the data electrodes $D_1$–$D_m$ and corresponds to a discharge cell 12 to be operated so as to emit light in the second line. At the same time, a scan pulse voltage of 0 is applied to the scanning electrode $SCN_2$ of the second line. In this state, the voltage between the surface of the insulator layer 7 and the surface of the protective film 3 on the scanning electrode $SCN_2$ at the intersection of the designated data electrode $D_j$ and the scanning electrode $SCN_2$ is calculated by adding the positive wall voltage stored at the surface of the insulator layer 7 on the designated data electrode $D_j$ to the write pulse voltage of +Vw. Therefore, at this intersection, a write discharge occurs between the designated data electrode $D_j$ and the scanning electrode $SCN_2$ and between the sustain electrode $SUS_2$ and the scanning electrode $SCN_2$. As a result, at this intersection, a positive wall voltage is stored at the surface of the protective film 3 on the scanning electrode $SCN_2$, a negative wall voltage at the surface of the protective film 3 on the sustain electrode $SUS_2$, and a negative wall voltage at the surface of the insulator layer 7 on the data electrode $D_j$.

Successively, the same operation is carried out for all remaining lines. Finally, a positive write pulse voltage of +Vw is applied to a designated data electrode $D_j$ that is selected from the data electrodes $D_1$–$D_m$ and corresponds to s discharge cell 12 to be operated so as to emit light in the nth line. At the same time, a scan pulse voltage of 0 is applied to a scanning electrode $SCN_n$ of the nth line. This causes write discharges between the designated data electrode $D_j$ and the scanning electrode $SCN_n$ and between a sustain electrode $SUS_n$ and the scanning electrode $SCN_n$ at the intersection of the designated data electrode $D_j$ and the scanning electrode $SCN_n$. As a result, at this intersection, a positive wall voltage is stored at the surface of the protective film 3 on the scanning electrode $SCN_n$, a negative wall voltage at the surface of the protective film 3 on the sustain electrode $SUS_n$, and a negative wall voltage at the surface of the insulator layer 7 on the data electrode $D_j$.

Thus, the write operation in the write period is completed.

In the subsequent sustain period, the voltage of all the scanning electrodes $SCN_1$–$SCN_n$ and all the sustain electrodes $SUS_1$–$SUS_n$ is restored to 0 for the time being. After that, initially a positive sustain pulse voltage of +Vm is applied to all the scanning electrodes $SCN_1$–$SCN_n$. In this state, the voltage between the surface of the protective film 3 on a scanning electrode $SCN_i$ (i indicates one or more integers of 1 to n) in the discharge cell 12 in which the write discharge has occurred and the surface of the protective film 3 on the sustain electrodes $SUS_1$–$SUS_n$ is calculated by adding the positive wall voltage stored at the surface of the protective film 3 on the scanning electrode $SCN_i$ and the negative wall voltage stored at the surface of the protective film 3 on a sustain electrode $SUS_i$, which have been stored in the write period, to the sustain pulse voltage of +Vm and thus exceeds the discharge starting voltage. Therefore, in the discharge cell in which the write discharge has occurred, a sustain discharge occurs between the scanning electrode $SCN_i$ and the sustain electrode $SUS_i$. In the discharge cell in which the sustain discharge has occurred, a negative wall voltage is stored at the surface of the protective film 3 on the scanning electrode $SCN_i$, and a positive wall voltage is stored at the surface of the protective film 3 on the sustain electrode $SUS_i$. After that, the sustain pulse voltage applied to the scanning electrodes $SCN_1$–$SCN_n$ is restored to 0.

Successively, a positive sustain pulse voltage of +Vm is applied to all the sustain electrodes $SUS_1$–$SUS_n$. In this state, in the discharge cell in which the sustain discharge has occurred, the voltage between the surface of the protective film 3 on the sustain electrode $SUS_i$ and the surface of the protective film 3 on the scanning electrode $SCN_i$ is calculated by adding the negative wall voltage at the surface of the protective film 3 on the scanning electrode $SCN_i$ and the positive wall voltage at the surface of the protective film 3 on the sustain electrode $SUS_i$, which have been stored by the preceding sustain discharge, to the sustain pulse voltage of +Vm. Therefore, in the discharge cell in which this sustain discharge has occurred, a sustain discharge occurs between the sustain electrode $SUS_i$ and the scanning electrode $SCN_i$. Thus, in this discharge cell, a negative wall voltage is stored at the surface of the protective film 3 on the sustain electrode $SUS_i$ and a positive wall voltage is stored at the surface of the protective film 3 on the scanning electrode $SCN_i$. After that, the sustain pulse voltage is restored to 0.

Hereafter in the same way as mentioned above, a positive sustain pulse voltage of +Vm is applied to all the scanning electrodes $SCN_1$–$SCN_n$ and all the sustain electrodes $SUS_1$–$SUS_n$ alternately, thus causing a continuous sustain discharge. At the conclusion of the sustain period, a positive sustain pulse voltage of +Vm is applied to all the scanning electrodes $SCN_1$–$SCN_n$. In this state, in the discharge cell in which the sustain discharge has occurred, the voltage between the surface of the protective film 3 on the scanning electrode $SCN_i$ and the surface of the protective film 3 on the sustain electrode $SUS_i$ is calculated by adding the positive wall voltage at the surface of the protective film 3 on the scanning electrode $SCN_i$ and the negative wall voltage at the surface of the protective film 3 on the sustain electrode $SUS_i$, which have been stored by the preceding sustain discharge, to the sustain pulse voltage of +Vm. Therefore, in the discharge cell in which this sustain discharge has occurred, a sustain discharge occurs between the scanning electrode $SCN_i$ and the sustain electrode $SUS_i$. Thus, in this discharge cell, a negative wall voltage is stored at the surface of the protective film 3 on the scanning electrode $SCN_i$ and a positive wall voltage is stored at the surface of the protective film 3 on the sustain electrode $SUS_i$. After that, the sustain pulse voltage is restored to 0. Thus, the sustain operation in the sustain period is completed. Visible emission from the phosphors 10 excited by ultraviolet rays generated by this sustain discharge is used for display.

In the subsequent erase period, a lamp voltage that increases gradually from a voltage of 0 toward +Ve is applied to all the sustain electrodes $SUS_1$–$SUS_n$. In this state, in the discharge cell in which the sustain discharge has occurred, the voltage between the surface of the protective film 3 on the scanning electrode $SCN_i$ and the surface of the protective film 3 on the sustain electrode $SUS_i$ is calculated by adding a negative wall voltage at the surface of the protective film 3 on the scanning electrode $SCN_i$ and a positive wall voltage at the surface of the protective film 3 on the sustain electrode $SUS_i$ at the conclusion of the sustain period, to this lamp voltage. Therefore, in the discharge cell in which the sustain discharge has occurred, a weak erase discharge occurs between the sustain electrode $SUS_i$ and the scanning electrode $SCN_i$, and therefore the negative wall voltage at the surface of the protective film 3 on the scanning electrode $SCN_i$ and the positive wall voltage at the surface of the protective film 3 on the sustain electrode $SUS_i$ are weakened, thus terminating the erase discharge.

Thus, the erase operation in the erase period is completed.

In the above operations, as to the discharge cells that are not operated to emit light, the initialization discharge occurs in the initialization period, but the write discharge, the sustain discharge, and the erase discharge do not take place. Therefore, in the discharge cells that are not operated to emit light, the wall voltage stored at the surface of the protective film 3 on the scanning electrode $SCN_i$ and the sustain electrode $SUS_i$ and the wall voltage stored at the surface of the insulator layer 7 on the data electrode $D_h$ (h indicates one or more integers of 1 to n, which is not the same as j) are maintained at the levels when the initialization period was completed.

By all the operations described above, one picture in the first subfield is displayed. The same operations are carried out over the second to the eighth subfields. The luminance of the discharge cells that are operated to emit light in these subfields is determined depending on how many times the sustain pulse voltage of +Vm is applied. Therefore, for instance, by suitably setting the number of times of the application of the sustain pulse voltage in each subfield so that one field consists of eight subfields whose relative magnitudes of the luminance obtained by the sustain discharge are $2^0, 2^1, 2^2, \ldots 2^7$, a display having $2^8$=256 shades of gray can be obtained.

According to the conventional driving method described above, in the display of a so-called "black picture" in which no discharge cell is in a display state, the write discharge, the sustain discharge, and the erase discharge do not occur and only the initialization discharge occurs. This initialization discharge is weak and its discharge emission also is weak. Therefore, this driving method is characterized by a high contrast in a panel. For example, when the 256 shades of gray were displayed using a structure in which each field consists of eight subfields in a 42-inch AC plasma display panel having a matrix structure formed of 480 rows and 852×3 columns, the emission luminance obtained by the first and second initialization discharges in the initialization period in each subfield was 0.15 cd/m$^2$. Therefore, the sum of the emission luminance in the eight subfields is 0.15×8=1.2 cd/m$^2$. Since the maximum luminance is 420 cd/m$^2$, the contrast in this panel is 420/1.2:1=350:1. Thus, a quite high contrast can be obtained.

As described above, in the above-mentioned conventional driving method, a quite high contrast can be obtained when the panel display is carried out under a normal lighting condition. However, since an initialization discharge occurs twice in each subfield without exception, even the emission caused by these weak initialization discharges has luminance so high as to be noticeable when the panel display is carried out in dark surroundings. Therefore, when the panel display is carried out in a place where it is not so bright, poor visibility of the black display has been a problem.

SUMMARY OF THE INVENTION

In order to solve such a problem, the present inventors studied the role of the initialization operation in the initialization period and achieved an improvement for carrying out the initialization operation efficiently.

First, the description is directed to the reason for which the initialization operation is required in each subfield in the conventional driving method. In this case, suppose Vw=70 V and Vm=200V in a conventional driving waveform shown in FIG. 5.

In order to cause the write discharge in the write period, it is necessary to apply at least a voltage equal to a discharge starting voltage (for example, about 250 V) to the discharge space between a data electrode $D_j$ and a scanning electrode $SCN_i$ in a designated discharge cell. In the write operation, the scanning electrode $SCN_i$ is maintained at a voltage of 0 and a write voltage of 70V is applied to the data electrode $D_j$ . Therefore, in order to carry out the write operation stably, it is necessary to pre-store a wall voltage of about 200 V on the insulator layer 7 on the data electrode $D_j$. Suppose this wall voltage required for writing is Vwrite (about 200V).

A wall voltage is stored on the insulator layer 7 on the data electrode $D_j$ by the sustain operation in the sustain period. It is conceivable that the value of the wall voltage at the conclusion of the sustain period is one approximately intermediate between the voltage applied to the scanning electrode $SCN_i$ and the voltage applied to the sustain electrode $SUS_i$. Suppose this wall voltage is Vsustain (about 100V).

Thus, during the shift from the conclusion of the sustain operation in any subfield to the write operation in the subsequent subfield, it is necessary to change the wall voltage on the insulator layer 7 on the data electrode $D_j$ from Vsustain to Vwrite. One of the main roles of the initialization operation is to compensate for the difference between the wall voltages of Vwrite and Vsustain (about 100 V). The initialization operation is indispensable for operating a panel stably.

From the above-described observation, the following concept was obtained. That is, by carrying out an operation that enables the wall voltage Vsustain on the insulator layer 7 on the data electrode $D_j$ at the conclusion of the sustain period in any subfield to be almost the same as the wall voltage Vwrite required in the write period in the subsequent subfield, the initialization operation can be simplified and unnecessary emission caused by the initialization operation can be avoided. The present invention is based on this concept and aims to provide a method of driving a panel that enables the visibility of a black picture to be improved greatly and the contrast to be enhanced considerably at the same time.

A method of driving an AC plasma display panel according to the present invention was obtained by improving the driving method of carrying out gray-scale display using a structure in which each field consists of a plurality of subfields, each of which includes an initialization period, a write period, and a sustain period. The method of the present invention is characterized in that at least in one predetermined subfield out of the plurality of subfields, at least a part of a sustain operation in the sustain period and at least a part of an initialization operation in the initialization period in a subsequent subfield are carried out at the same time.

According to this method, in the second and later subfields, an initialization discharge occurs only in discharge cells that have been operated to emit light in each preceding subfield, and in discharge cells that have not been operated to emit light, the initialization discharge can be prevented from occurring.

Further, since the time required for initialization is shortened greatly and the time required for erasure is omitted, the operation time can be shortened greatly compared to that in the conventional driving method. Therefore, the present invention is a driving method effective for a large panel or a high resolution panel.

In the above-mentioned method, the initialization operation in the predetermined subfield may include a first initialization operation and a subsequent second initialization operation, and an erase operation for terminating a sustain discharge may be carried out at the same time the second initialization operation is carried out.

The method of driving an AC plasma display panel according to the present invention is one for driving an AC plasma display panel in which a substrate on which scanning electrodes and sustain electrodes are formed and another substrate on which data electrodes are formed are arranged opposing each other. The method of the present invention was obtained by improving a driving method in which one field consists of a plurality of subfields, each of which includes an initialization period, a write period, and a sustain period. The method of the present invention is characterized in that at least the predetermined subfield is designed so that at least in a part of the sustain period, a sustain voltage for maintaining a discharge is applied between the sustain electrodes and the scanning electrodes and at the same time a voltage that is beyond the discharge starting voltage is applied between the data electrodes and the scanning electrodes.

In this method, the subsequent subfield of the predetermined subfield may be designed so as to have the initialization period subsequent to the sustain period in the predetermined subfield and so that in the initialization period, a positive voltage is applied to the sustain electrodes and a lamp voltage is applied to the scanning electrodes. The lamp voltage varies from a voltage providing the scanning electrodes with a voltage below the discharge starting voltage with respect to the sustain electrodes toward a voltage providing the scanning electrodes with a voltage beyond the discharge starting voltage with respect to the sustain electrodes.

Further, a method of driving an AC plasma display panel according to the present invention is one for driving an AC plasma display panel in which a substrate on which scanning electrodes and sustain electrodes are formed and another substrate on which data electrodes are formed are arranged opposing each other. The method of the present invention was obtained by improving a driving method in which one field consists of a plurality of subfields, each of which includes an initialization period, a write period, and a sustain period. The method of the present invention is characterized in that in the sustain period at least in one predetermined subfield out of the plurality of subfields, the value at the lowest level of a sustain pulse voltage applied to the scanning electrodes and the sustain electrodes is set to be higher than that at the lowest level of a scan pulse voltage applied to the scanning electrodes in the write period, whereby a sustain operation in the sustain period in the predetermined subfield and an initialization operation in the initialization period in a subfield subsequent to the predetermined subfield are carried out at the same time.

This method may be designed so as to carry out the last sustain operation in the sustain period and an erase operation for terminating the sustain discharge at the same time by setting the width of the last sustain pulse applied to the scanning electrodes or the sustain electrodes in the sustain period in the predetermined subfield to be shorter than other sustain pulse widths.

DETAILED DESCRIPTION OF THE INVENTION

Figure 4:
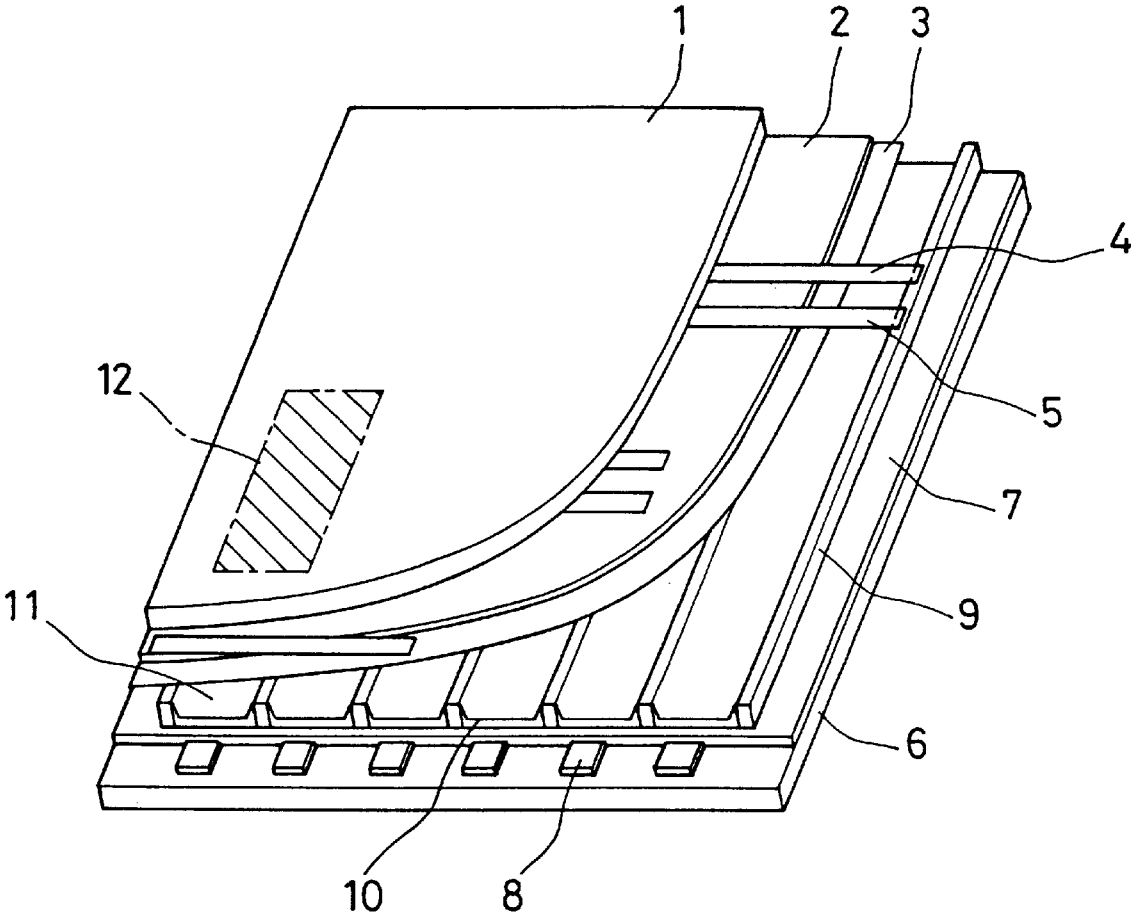
FIG. 4 is a partially cutaway perspective view of an AC plasma display panel.
Figure 5:
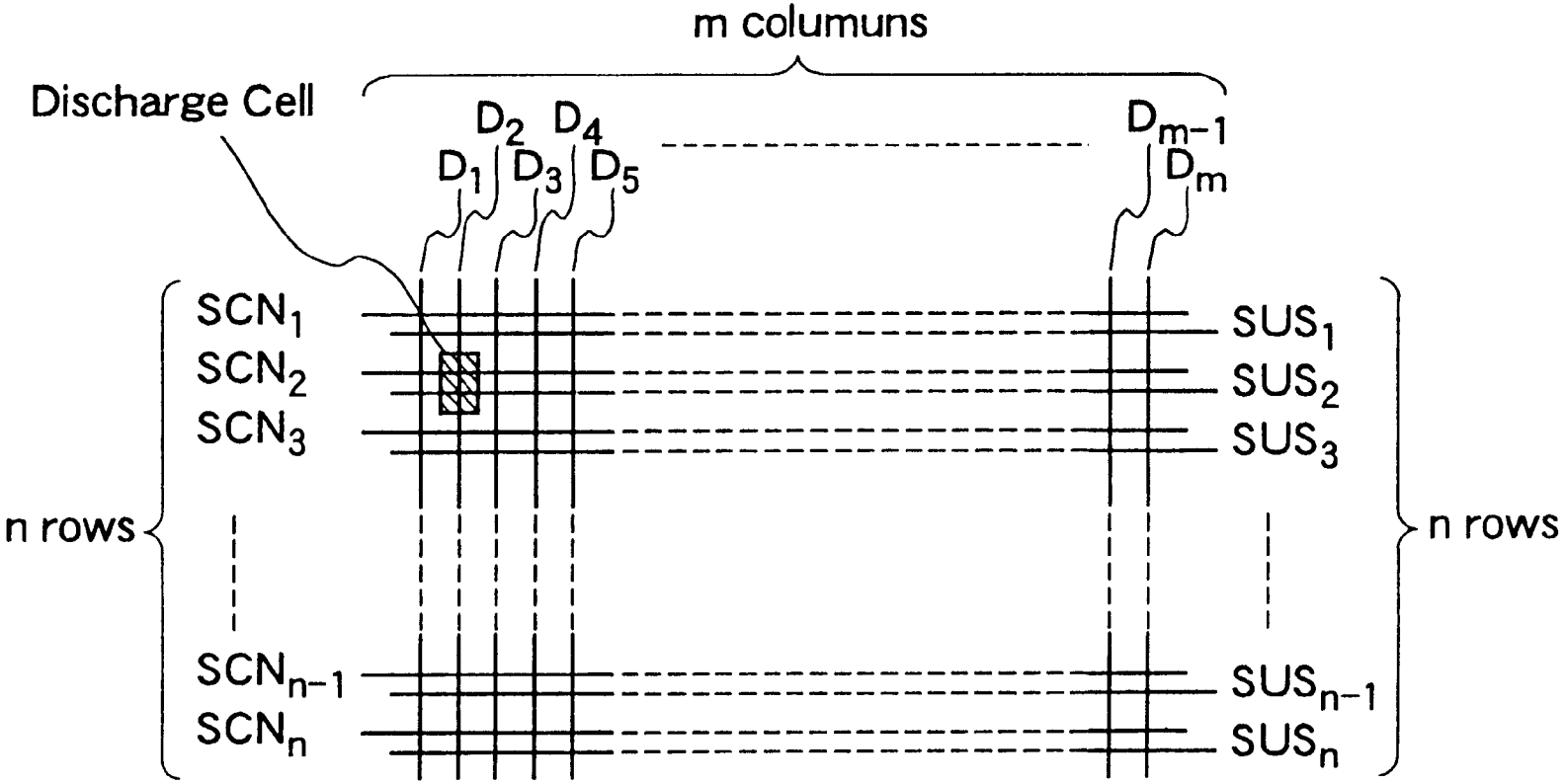
FIG. 5 is a diagram showing an electrode array in the AC plasma display panel.

The driving method of the present invention can be applied to an AC plasma display panel (hereinafter referred to also as a "panel") with the same configuration as that of the panel shown in FIG. 4 as a conventional example. The electrode array in the panel also may be the same as that shown in FIG. 5. Therefore, their descriptions are not repeated.

First Embodiment

Figure 1:
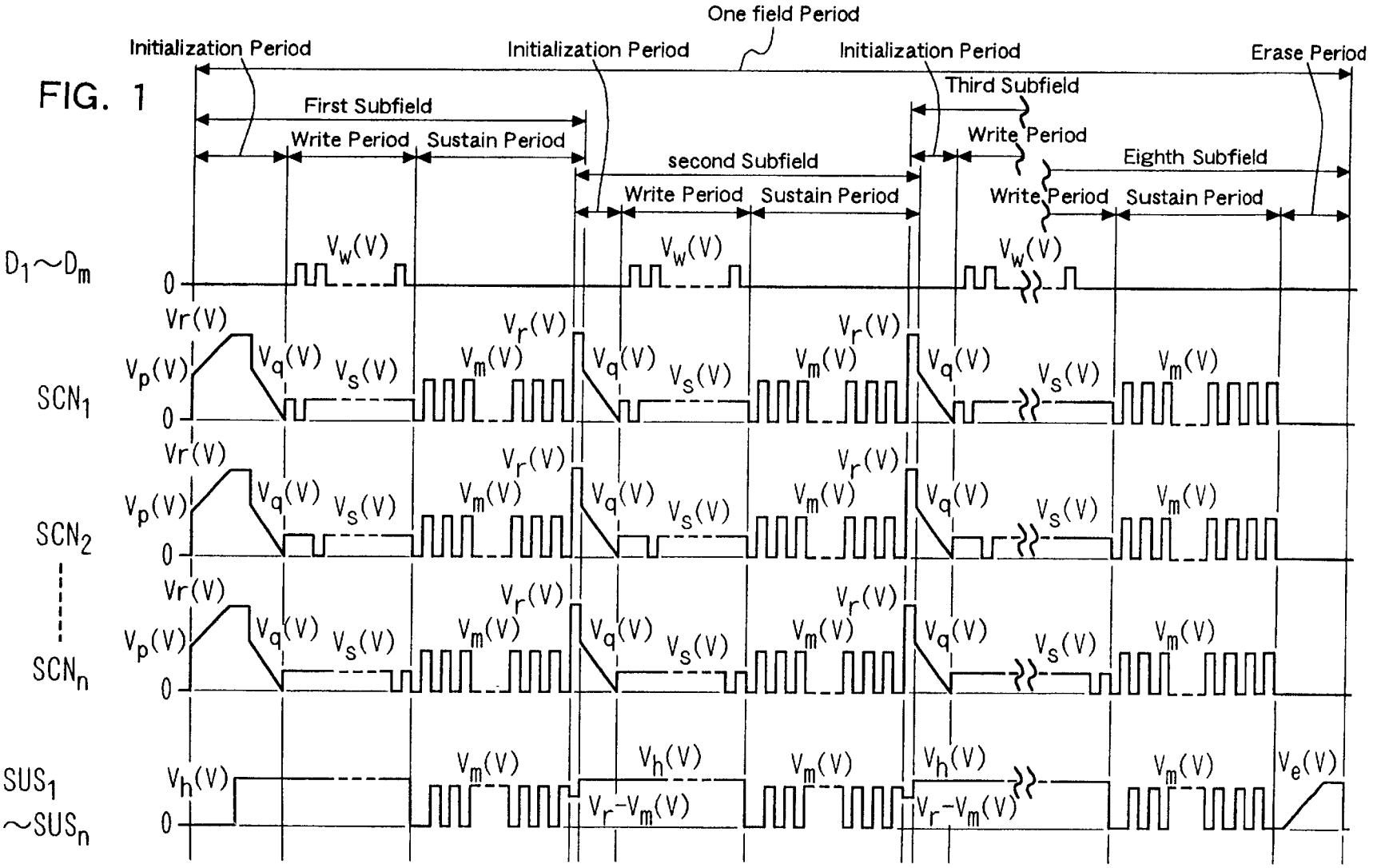
FIG. 1 shows a timing chart of a driving waveform illustrating a method of driving an AC plasma display panel according to a first embodiment of the present invention.

A method of driving a panel according to a first embodiment of the present invention is described with reference to FIG. 1 showing a timing chart of a driving waveform.

As shown in FIG. 1, one field consists of first to seventh subfields including an initialization period, a write period, and a sustain period, and an eighth subfield including an initialization period, a write period, a sustain period, and an erase period. Using this, 256 shades of gray are displayed. In the seven subfields except for the first subfield out of these eight subfields, a driving voltage is set so that a part of an initialization operation in each initialization period is carried out at the same time the last sustain operation in the sustain period in each preceding subfield is carried out. In other words, in the first subfield, the initialization period is provided independently and further the write period and the sustain period are provided, but the erase period is not provided. At the same time the sustain operation is carried out by the last application of a sustain pulse voltage in the sustain period, the initialization operation in the initialization period in the second subfield is carried out. Similarly, in each of the subsequent third to seventh subfields, the initialization period, the write period, and the sustain period are provided, but the erase period is not provided. The initialization operation in each initialization period is carried out at the same time the last sustain operation in the sustain period in each preceding subfield is carried out. Further, in the last (eighth) subfield, the initialization operation in the initialization period also is carried out at the same time the last sustain operation in the sustain period in the seventh subfield is carried out. On the other hand, the sustain period is provided independently and the erase period is provided subsequent to the sustain period.

Figure 6:
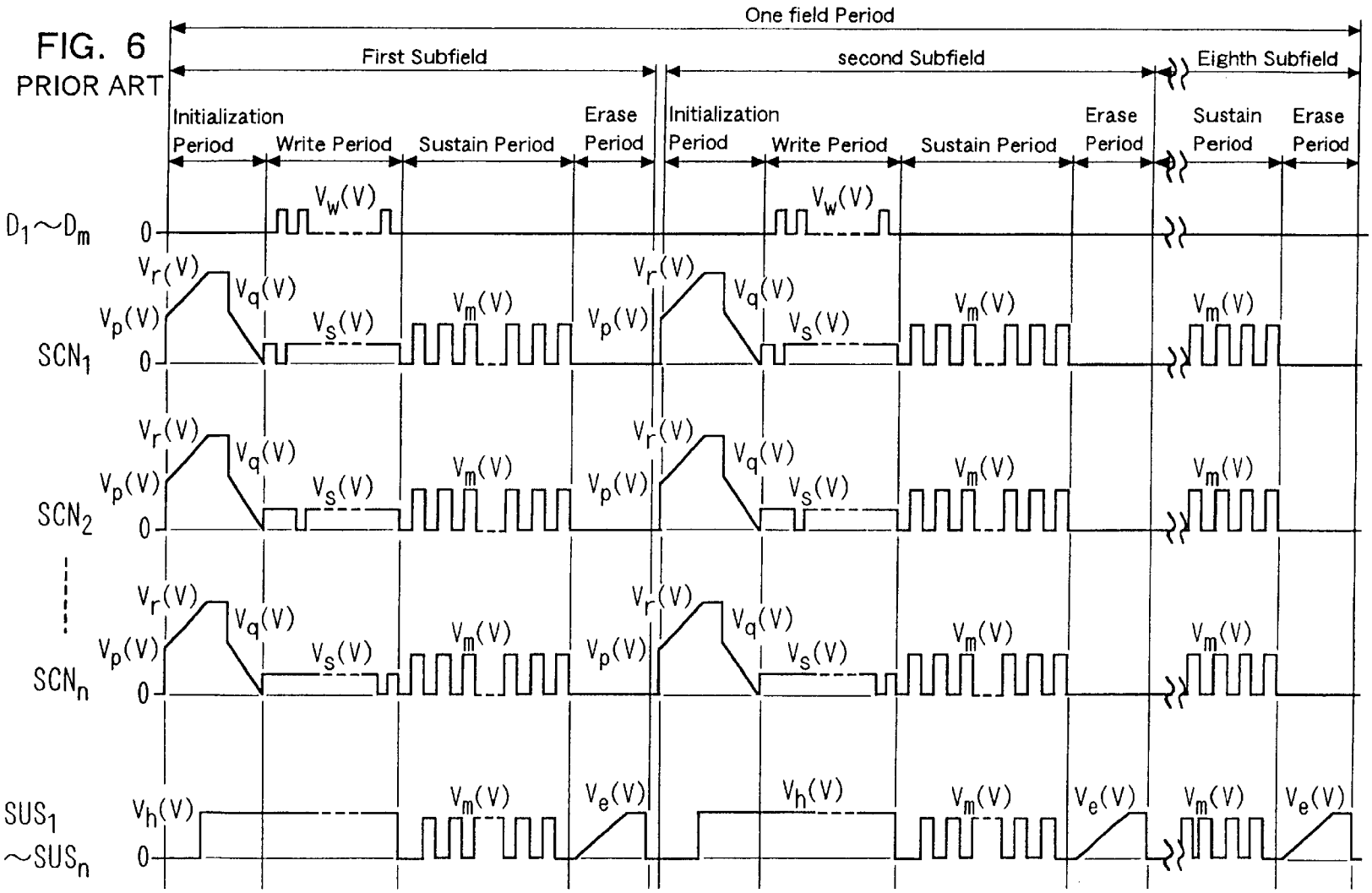
FIG. 6 PRIOR ART
FIG. 6 shows a timing chart of a driving waveform illustrating a conventional method of driving an AC plasma display panel.

In FIG. 1, the operations in the initialization period and the write period, and the operation before the last part of the sustain period are the same as those described with reference to the conventional example shown in FIG. 6. Therefore, their description is omitted here. It is the main point of the present invention that the operation in the last part of the sustain period is carried out at the same time the operation in the initialization period in the subsequent subfield is carried out, which is described in detail with reference to FIGS. 1, 4, and 5 as follows.

As shown in FIG. 1, the last part of the sustain period in the first subfield overlaps with the first part of the initialization period in the second subfield. In this overlapping period, a positive pulse voltage of Vr is applied to all the scanning electrodes $SCN_1$–$SCN_n$ and a positive pulse voltage of (Vr–Vm) to all the sustain electrodes $SUS_1$–$SUS_n$. Subsequently, in the second part of the initialization period in the second subfield, a positive voltage of Vh is applied to all the sustain electrodes $SUS_1$–$SUS_n$ and a lamp voltage decreasing gradually from a voltage of Vq toward 0 to all the scanning electrodes $SCN_1$–$SCN_n$.

In the above-mentioned operations, attention is directed to the operation in the last part of the sustain period in the first subfield. In this last part, the voltage between all the scanning electrodes $SCN_1$–$SCN_n$ and all the sustain electrodes $SUS_1$–$SUS_n$ is Vr–(Vr–Vm)=Vm. Therefore, the relationship between the scanning electrodes $SCN_1$ –$SCN_n$ and the sustain electrodes $SUS_1$–$SUS_n$ is the same as that in the operation preceding to the last part of the sustain period. That is to say, the relationship is equal to that in the case where the sustain electrodes $SUS_1$–$SUS_n$ are maintained at a voltage of 0 and a positive sustain pulse voltage of Vm is applied to the scanning electrodes $SCN_1$–$SCN_n$. Therefore, as in the normal sustain operation, the voltage between the surface of a protective film 3 on a scanning electrode $SCN_i$ (i indicates one or more integers of 1 to N) and the surface of the protective film 3 on a sustain electrode $SUS_i$ in a discharge cell 12 in which a write discharge has occurred is calculated by adding a positive wall voltage stored at the surface of the protective film 3 on the scanning electrode $SCN_i$ and a negative wall voltage stored at the surface of the protective film 3 on the sustain electrode $SUS_i$ to the sustain pulse voltage of Vm, which exceeds the discharge starting voltage. Thus, in the discharge cell 12 in which the write discharge has occurred, a sustain discharge occurs between the scanning electrode $SCN_i$ and the sustain electrode $SUS_i$. As a result, in this discharge cell 12, a negative wall voltage is stored at the surface of the protective film 3 on the scanning electrode $SCN_i$ and a positive wall voltage is stored at the surface of the protective film 3 on the sustain electrode $SUS_i$. Thus, as in the conventional example, the last sustain operation is carried out. With respect to the discharge cells in which writing was not carried out, such a sustain discharge does not occur.

Next, attention is directed to the initialization operation in the second subfield. The first part of the initialization operation corresponds to the last part of the sustain period in the first subfield. In the initialization operation in this first part, the voltage between all the scanning electrodes $SCN_1$–$SCN_n$ and all the data electrodes $D_1$–$D_m$ is Vr. As described above, the voltage between all the scanning electrodes $SCN_1$–$SCN_n$ and all the sustain electrodes $SUS_1$–$SUS_n$ is Vm. In the discharge cell in which the write discharge has occurred, the voltage between the surface of an insulator layer 7 on a data electrode $D_j$ and the surface of the protective film 3 on a scanning electrode $SCN_i$ is calculated by subtracting the wall voltage (about Vsustain) stored at the surface of the insulator layer 7 on the data electrode $D_j$ during the write operation from the sum of Vr and the positive wall voltage stored at the surface of the protective film 3 on the scanning electrode $SCN_i$, which exceeds the discharge starting voltage. Because of this, in the discharge cell in which the write discharge has occurred, a discharge occurs from the scanning electrode $SCN_i$ to the data electrode $D_j$. Further, as described above, a discharge also occurs from the scanning electrodes $SCN_1$–$SCN_n$ to the sustain electrodes $SUS_1$–$SUS_n$. This is the first initialization discharge, and a negative wall voltage is stored at the surface of the protective film 3 on the scanning electrode $SCN_i$ and a positive wall voltage at the surface of the insulator layer 7 on the data electrode $D_j$ and at the surface of the protective film 3 on the sustain electrode $SUS_i$. This first initialization discharge is not weak but strong to some extent.

On the other hand, in the discharge cells in which writing has not been carried out, the voltage between the surface of the insulator layer 7 on the data electrode $D_h$ (h indicates one or more integers of 1 to n, which is not the same as j) and the surface of the protective film 3 on the scanning electrode $SCN_i$ is calculated by subtracting the positive wall voltage stored at the surface of the insulator layer 7 on the data electrode $D_h$ from the sum of Vr and the negative wall voltage stored at the surface of the protective film 3 on the scanning electrode $SCN_i$, which does not exceed the discharge starting voltage. Therefore, in the discharge cells in which the writing has not been carried out in the first subfield, the first initialization discharge does not occur.

An initialization operation in the second part of the initialization period is the same as that in the later part of the initialization period in the first subfield. A positive voltage of Vh is applied to all the sustain electrodes $SUS_1$–$SUS_n$. To all the scanning electrodes $SCN_1$–$SCN_n$, a lamp voltage is applied, which decreases gradually from a voltage of Vq toward a voltage of 0. The voltages of Vq and 0 provide the scanning electrodes $SCN_1$–$SCN_n$ with voltages below and beyond the discharge starting voltage with respect to the sustain electrodes $SUS_1$–$D_n$, respectively. During this lamp voltage decrease, in the discharge cell 12 in which the first initialization discharge has occurred, a second weak initialization discharge occurs from the sustain electrode $SUS_i$ to the scanning electrode $SCN_i$. Thus, the negative wall voltage stored at the surface of the protective film 3 on the scanning electrode $SCN_i$ and the positive wall voltage stored on the surface of the sustain electrode $SUS_i$ are weakened. On the other hand, the positive wall voltage at the surface of the insulator layer 7 on the data electrode $D_j$ is maintained. In the discharge cells in which the first initialization discharge has not occurred, the wall voltage at the surface of the protective film 3 on the scanning electrode $SCN_i$ and the sustain electrode $SUS_i$ already has been weakened by the operation in the second part of the initialization period in the first subfield and therefore the aforementioned second initialization discharge does not occur.

As can be understood from the above description, the initialization operation in the second part of the initialization period in the second subfield is carried out directly after the conclusion of the last sustain discharge in the first subfield. In this state, in the discharge cells 12 that are operated to emit light, a weak initialization discharge occurs from the sustain electrodes $SUS_1$–$SUS_n$ to the scanning electrodes $SCN_1$–$SCN_n$, thus weakening the negative wall voltage stored at the surface of the protective film 3 on the scanning electrodes $SCN_1$–$SCN_n$ and the positive wall voltage stored at the surface of the protective film 3 on the sustain electrodes $SUS_1$–$SUS_n$. This means that the erase operation for terminating the sustain discharge is carried out and therefore it is not required to provide an erase period necessarily.

During the above-mentioned operations, in the discharge cells that have been operated to emit light in the first subfield, the first initialization discharge is not weak, which is caused by the initialization operation in the first part of the initialization period in the second subfield. The luminance obtained by this initialization discharge is considerably higher than that obtained by the weak second initialization discharge caused by the initialization operation in the second part of the initialization period. However, since these two initialization discharges are carried out only in the discharge cells 12 that have been operated to emit light, the luminance obtained by the initialization discharge in the second subfield is merely added to the luminance obtained by the sustain discharge in the first subfield.

With respect to the discharge cells that are not operated to emit light, the initialization discharge occurs during the initialization period in the first subfield, but a write discharge, a sustain discharge, and an erase discharge do not occur. Therefore, in the regions corresponding to the discharge cells, the wall voltage at the surface of the protective film 3 on the scanning electrodes $SCN_1$–$SCN_n$ and the sustain electrodes $SUS_1$–$SUS_n$ and the wall voltage at the surface of the insulator layer 7 on the data electrodes $D_1$–$D_m$ are maintained at the levels when the initialization period in the first subfield was concluded.

As in the operations described above, although the erase period is not provided in the second to seventh subfields, the write operation, the sustain operation, the erase operation, and the initialization operation in the subsequent subfield are carried out stably. Similarly in each of the second and later subfields, as to the discharge cells that are not operated to emit light, the initialization discharge, the write discharge, the sustain discharge, and the erase discharge do not occur. Therefore, in the regions corresponding to the discharge cells, the wall voltage at the surface of the protective film 3 on the scanning electrodes $SCN_1$–$SCN_n$ and the sustain electrodes $SUS_1$–$SUS_n$ and the wall voltage at the surface of the insulator layer 7 on the data electrodes $D_1$–$D_m$ are maintained at the levels when the initialization period in the subfield preceding to each subfield was concluded.

As to the eighth subfield, individual sustain and erase periods are provided, and a normal sustain operation and a subsequent erase operation are carried out as in the conventional example. That is to say, the operations before reaching the initialization period in a first subfield in the subsequent field through the sustain period and the erase period in the eighth subfield shown in FIG. 1 are the same as those shown in the conventional example.

As described above, in the first embodiment shown in FIG. 1, the weak initialization discharge in the initialization period in the first subfield occurs in all the discharge cells regardless of whether they should be operated to emit light or not. On the contrary, in the second and later subfields, the initialization discharge is caused only in the discharge cells that have been operated to emit light, which serves as the initialization operation for each subsequent subfield. The luminance obtained by this discharge is merely added to the luminance obtained by the sustain discharge and therefore the emission due to such an initialization discharge does not occur in the discharge cells that have not been operated to emit light.

For instance, in a 42-inch AC plasma display panel with a matrix structure formed of 480 rows and 852×3 columns, the maximum luminance was 420 cd/m$^2$ when 256 shades of gray were displayed using a structure in which each field consists of eight subfields. On the other hand, the luminance obtained by the two initialization discharges in the initialization period in the first subfield was 0.15 cd/m$^2$. In this case, suppose Vp=Vq=Vm=190V, Vr=370 V Vs=70V and Vh=210 V. In the display ofa so-called "black picture" in which no discharge cell is operated to emit light, since only the emission due to the initialization discharge in the first subfield is caused, the luminance of black display is 0.15 cd/m$^2$, which is one eighth of the conventional one. Therefore, when panel display was carried out in a place where it was not so bright, the visibility of the black display was improved greatly compared to the conventional one. Further, the contrast in the panel according to the present embodiment was 420/0.15:1=2800:1 and thus extremely high contrast was obtained.

In addition, since a part of the initialization operation in each of the second to eighth subfields is carried out at the same time the last sustain operation in the sustain period in each preceding subfield is carried out, the time required for the initialization can be shortened. Furthermore, an individual erase period is not required to be provided, thus shortening the operation time considerably compared to that in the conventional driving method.

In the above-mentioned embodiment, the voltage of Vr applied in the initialization period in the first subfield and the voltage of Vr applied in the initialization period in the second to eighth subfields are set to be the same value. However, the voltages may be set to be different from each other.

Second Embodiment

Figure 2:
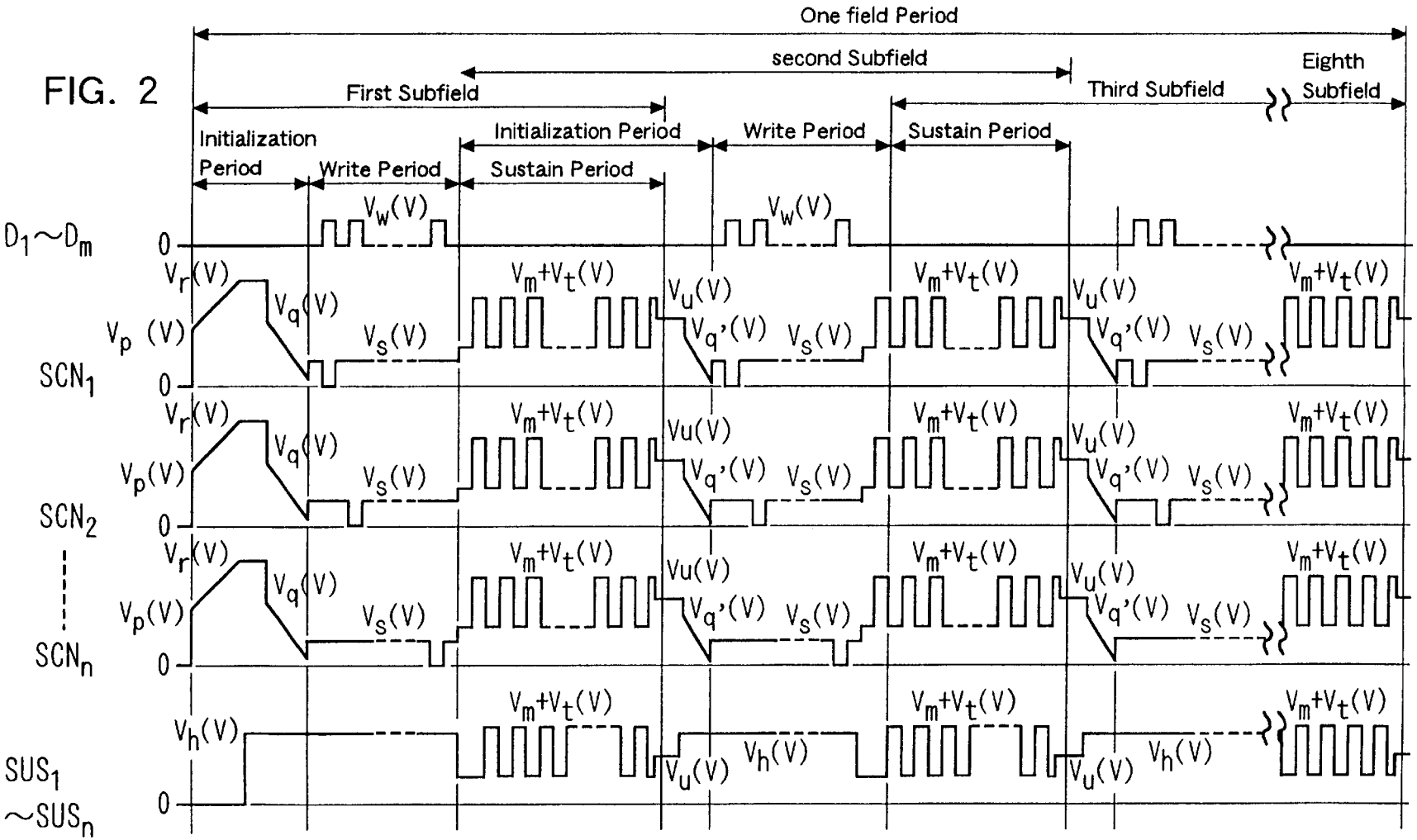
FIG. 2 shows a timing chart of a driving waveform illustrating a method of driving an AC plasma display panel according to a second embodiment of the present invention.

A method of driving a panel according to a second embodiment of the present invention is described with reference to FIG. 2 showing the timing chart of a driving waveform.

As shown in FIG. 2, one field consists of first to eighth subfields, each of which includes an initialization period, a write period, and a sustain period, and using this, 256 shades of gray are displayed. In the seven subfields except for the first subfield out of these eight subfields, a driving voltage is set so that a part of an initialization operation in the initialization period is carried out at the same time a sustain operation in the sustain period in a preceding subfield is carried out. In the first subfield, the initialization period, the write period, and the sustain period are provided independently, but no independent erase period is provided. In the second subfield, a part of the initialization period is provided so as to overlap with the sustain period in the first subfield, and subsequently the write period and the sustain period are provided, but no erase period is provided. That is to say, the initialization operation in the initialization period in the second subfield is carried out at the same time the sustain operation in the sustain period in the fist subfield is carried out. Similarly in the subsequent third to eighth subfields, an initialization period, a write period, and a sustain period are provided, but no erase period is provided. A part of the initialization operation in the initialization period in each subfield is carried out at the same time the sustain operation in the sustain period in each preceding subfield is carried out.

In FIG. 2, the operations in the initialization period and the write period in the first subfield are the same as those described with reference to the conventional example shown in FIG. 6. Therefore, their descriptions are omitted here. It is the main point of the present invention that the operation in the sustain period in the first subfield is carried out at the same time the operation in the initialization period in the second subfield is carried out, which is described in detail with reference to FIGS. 2 and 4 as follows.

As shown in FIG. 2, the sustain period in the first subfield overlaps with a first period of the initialization period in the second subfield. In this overlapping period, a voltage obtained by superposing a DC voltage of Vt on a sustain pulse voltage of Vm is applied to all the scanning electrodes $SCN_1$–$SCN_n$ and all the sustain electrodes $SUS_1$–$SUS_n$. In other words, while the value at the lowest level of the scan pulse voltage applied to the scanning electrodes $SCN_1$–$SCN_n$ in the write period is 0, the value at the lowest level of the sustain pulse voltage applied to the sustain electrodes $SUS_1$–$SUS_n$ and the scanning electrodes $SCN_1$–$SCN_n$ in the sustain period is set to be Vt that has a high potential. The pulse width of the last sustain pulse in the sustain period is shorter than that of the other sustain pulses. After the last sustain pulse, the voltage of the scanning electrodes $SCN_1$–$SCN_n$ and the voltage of the sustain electrodes $SUS_1$–$SUS_n$ are set to be the same voltage of Vu.

Subsequently, in the second period subsequent to the first period of the initialization period in the second subfield, a positive voltage of Vh is applied to all the sustain electrodes $SUS_1$–$SUS_n$ and a lamp voltage decreasing gradually from a voltage of Vq' toward 0 is applied to all the scanning electrodes $SCN_1$–$SCN_n$. In this state, it is not necessary to set the voltage Vq' to be equal to the voltage Vq. The voltage Vq' may be set to be lower than the voltage Vq.

In the above-mentioned operations, attention is directed to the operation in the sustain period in the first subfield. In this period, the voltage obtained by superposing a DC voltage of Vt on a sustain pulse voltage of Vm is applied to all the scanning electrodes $SCN_1$–$SCN_n$ and all the sustain electrodes $SUS_1$–$SUS_n$. Therefore, the relationship in voltage between the scanning electrodes $SCN_1$–$SCN_n$ and the sustain electrodes $SUS_1$–$SUS_n$ is the same as that in the operation in the conventional driving method, i.e. the same as that when the positive sustain pulse voltage of Vm is applied alternately to the sustain electrodes $SUS_1$–$SUS_n$ and the scanning electrodes $SCN_1$–$SCN_n$. Therefore, as in the conventional example, in the discharge cells in which the write discharge has occurred, the sustain discharge is caused continuously.

The pulse width of the sustain pulse voltage applied lastly in the sustain period is set to be shorter than a duration of 2 μs in which the discharge is concluded securely with the wall voltage having fully been formed. The voltage applied to the scanning electrodes $SCN_1$–$SCN_n$ and the voltage applied to the sustain electrodes $SUS_1$–$SUS_n$ after the last application of the sustain pulse voltage are set to be the same voltage of Vu. Therefore, the wall voltage at the surface of a protective film 3 on the scanning electrodes $SCN_1$–$SCN_n$ and the wall voltage at the surface of the protective film 3 on the sustain electrodes $SUS_1$–$SUS_n$ become almost the same, i.e. the erase operation is carried out. In the discharge cells in which no write discharge is caused, such a sustain discharge does not occur.

Next, attention is directed to the initialization period in the second subfield. A first period of the initialization period corresponds to the sustain period in the first subfield. In the initialization operation in this first period, the voltage between all the scanning electrodes $SCN_1$–$SCN_n$ and all the data electrodes $D_1$–$D_m$ is Vt or Vt +Vm. In the discharge cells in which the write discharge has occurred, the maximum voltage applied between the surface of an insulator layer 7 on a data electrode $D_j$ and the surface of the protective film 3 on the scanning electrode $SCN_i$ is calculated by subtracting the negative wall voltage stored at the surface of the insulator layer 7 on the data electrode $D_j$ by the write operation from the sum of Vt +Vm and the positive wall voltage stored at the surface of the protective film 3 on the scanning electrode $SCN_i$ (i.e. by adding the absolute values of them), which exceeds the discharge starting voltage. Because of this, in the discharge cells in which the write discharge has occurred, a discharge occurs from the scanning electrode $SCN_i$ to the data electrode $D_j$. This serves as the initialization discharge for the data electrode $D_j$, and a positive wall voltage is stored at the surface of the insulator layer 7 on the data electrode $D_j$, This initialization discharge is caused each time the sustain pulse voltage is applied during the first period in the initialization period (i.e. during the sustain period).

On the other hand, in the discharge cells in which writing has not been carried out, the maximum voltage applied between the surface of the insulator layer 7 on the data electrode $D_h$ and the surface of the protective film 3 on the scanning electrode $SCN_i$ is calculated by subtracting the positive wall voltage stored at the surface of the insulator layer 7 on the data electrode $D_h$ from the sum of Vt+Vm and the positive wall voltage stored at the surface of the protective film 3 on the scanning electrode $SCN_i$, which does not exceed the discharge starting voltage. Because of this, in the discharge cells in which writing has not been carried out in the first subfield, no initialization discharge for the data electrode $D_h$ occurs in the first period of the initialization period.

In the initialization operation in the second period of the initialization period, a positive voltage of Vh is applied to all the sustain electrodes $SUS_1$–$SUS_n$. To all the scanning electrodes $SCN_1$–$SCN_n$, a lamp voltage is applied, which decreases gradually from a voltage of Vq' toward a voltage of 0 that is the value at the lowest level of the scan pulse voltage applied to the scanning electrodes in the write period. The voltages of Vq' and 0 provide the scanning electrodes $SCN_1$–$SCN_n$ with voltages below and beyond the discharge starting voltage with respect to the sustain electrodes $SUS_1$–$D_n$, respectively. During this lamp voltage decrease, in the discharge cells in which the initialization discharge has occurred in the first period of the initialization period, the initialization discharge occurs again from the sustain electrode $SUS_i$ to the scanning electrode $SCN_i$. This initialization discharge is weak. Thus, a positive wall voltage is stored slightly at the surface of the protective film 3 on the scanning electrode $SCN_i$ and a negative wall voltage on the surface of the sustain electrode $SUS_i$. A weak discharge also occurs between the data electrode $D_j$ and the scanning electrode $SCN_i$. The positive wall voltage stored at the surface of the insulator layer 7 on the data electrode $D_j$ is adjusted to be a value suitable for the write operation. In the discharge cells in which the first initialization discharge has not occurred, the wall voltage already has been adjusted to be a value suitable for the write operation by the initialization operation in the preceding subfield and the above-mentioned second initialization discharge does not occur.

Similarly, as in the above description, although the erase period is not provided in the second to eighth subfields, the write operation, the sustain operation, the erase operation, and the initialization operation in each subsequent subfield are carried out stably. In each of the second and later subfields, in the discharge cells that are not operated to emit light, the initialization discharge, the write discharge, the sustain discharge, and the erasure discharge are not caused. The wall voltages at the surface of the protective film 3 on the scanning electrodes $SCN_1$–$SCN_n$ and the sustain electrodes $SUS_1$–$SUS_n$ and at the surface of the insulator layer 7 on the data electrodes $D_1$–$D_m$, which correspond to those discharge cells, are maintained at the levels when the initialization period in the subfield directly before each subfield was concluded.

As described above, in the second embodiment shown in FIG. 2, the weak initialization discharge in the initialization period in the first subfield occurs in all the discharge cells regardless of whether they should be operated to emit light or not. On the contrary, in each of the second and later subfields, the initialization discharge in the initialization period is caused only in the discharge cells that have been operated to emit light, which serves as the initialization operation for each subsequent subfield. The luminance obtained by the initialization discharge merely is added to the luminance obtained by the sustain discharge and therefore the emission due to such an initialization discharge does not occur in the discharge cells that have been operated to emit light.

For instance, in a 42-inch AC plasma display panel with a matrix structure formed of 480 rows and 852×3 columns, the maximum luminance was 420 cd/m$^2$ when 256 shades of gray were displayed using a structure in which each field consists of eight subfields. On the other hand, the luminance obtained by the first and second initialization discharges in the initialization period in the first subfield was 0.15 cd/m$^2$. In this case, suppose Vp=190 V, Vq=190 V, Vm=200 V, Vt=100 V, Vu=200 V, Vh=300 V, Vq'=100V, and Vs=70 V. In the display of a so-called "black picture" in which no discharge cell is operated to emit light, since only the emission due to the initialization discharge in the first subfield is caused, the luminance of the black display is 0.15 cd/m$^2$, which is one eighth of the conventional one. Therefore, when panel display was carried out in a place where it was not so bright, the visibility of the black display was increased extremely compared to the conventional one.

Further, the contrast in the panel according to the present embodiment was 420/0.15:1=2800:1 and thus extremely high contrast was obtained.

In addition, since a part of the initialization operation in the initialization period in each of the second to eighth subfields is carried out at the same time the sustain operation in the sustain period in each preceding subfield is carried out, the time required for initialization can be shortened considerably. Furthermore, it is not necessary to provide an individual erase period, and therefore the operation time can be shortened greatly compared to that in the conventional driving method. In the present embodiment, the initialization period in one field is 1 ms, and thus the initialization period was shortened greatly compared to 2.8 ms, which is the duration required for the initialization period and the erase period in the conventional driving method. Consequently, this driving method can be effective for a large panel or a high resolution panel that requires increased operation time.

Third Embodiment

Figure 3:
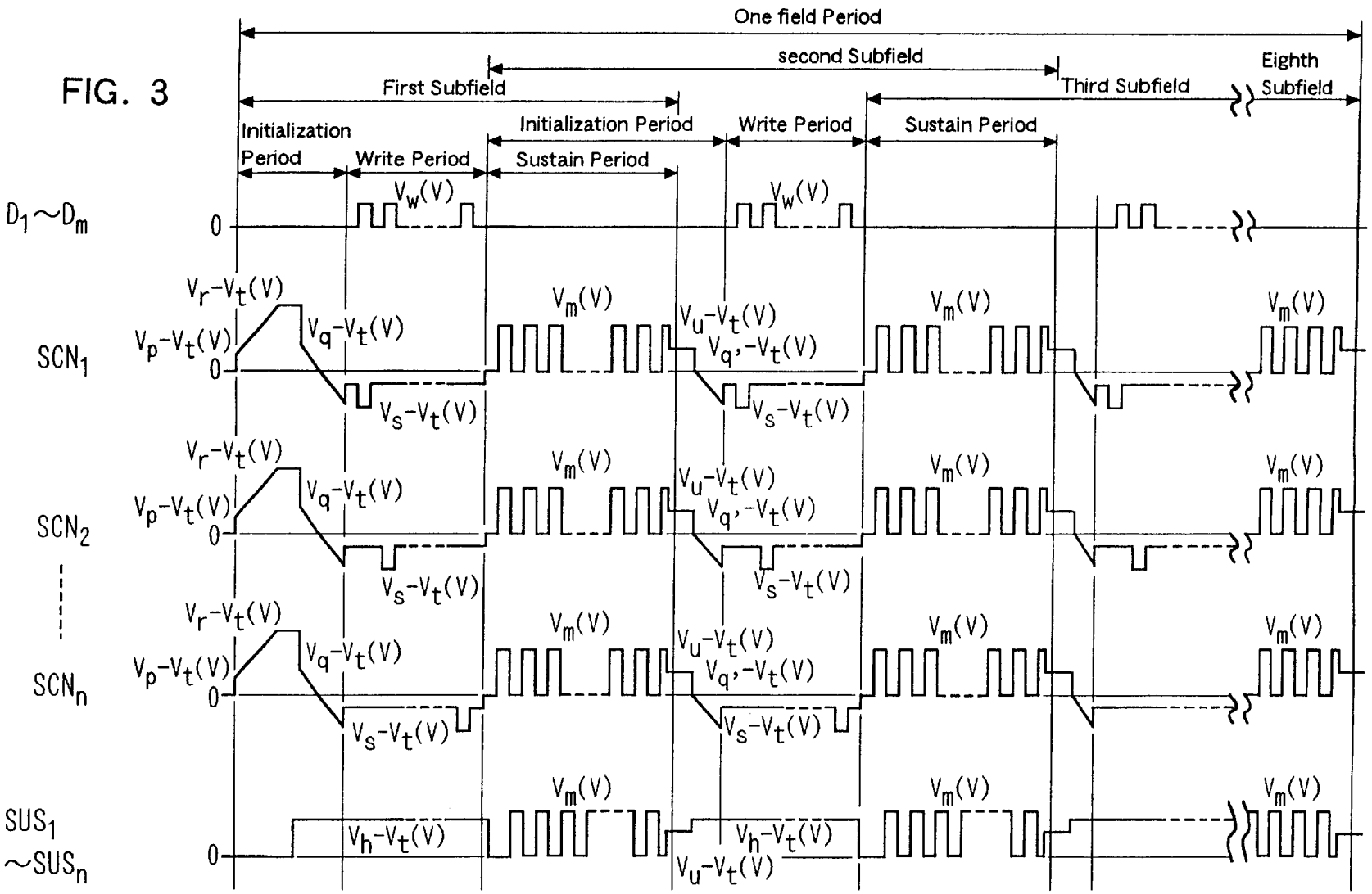
FIG. 3 shows a timing chart of a driving waveform illustrating a method of driving an AC plasma display panel according to a third embodiment of the present invention.

The timing chart of a driving waveform according to a third embodiment is shown in FIG. 3.

In an AC plasma display panel, discharge cells are surrounded by dielectrics and the driving waveform of each electrode is applied to discharge cells in a manner of capacitive coupling. Therefore, the AC plasma display panel has a characteristic that its operation is not changed even if a DC level of each driving waveform is shifted. Utilizing this characteristic, the driving voltage waveform shown in FIG. 3 is obtained by lowering the voltage waveform for operating the scanning electrodes and the voltage waveform for operating the sustain electrodes shown in FIG. 2 by a DC voltage of Vt as a whole. By applying this driving voltage waveform, the same operations as in the embodiment shown in FIG.2 can be carried out. In this case, since the sustain pulse of Vm can be determined on the basis of 0V, the circuit structure is simple and practical.

In the above-mentioned embodiments 2 and 3, the width of the last sustain pulse in each sustain period was shortened and the erase operation for terminating the sustain discharge was carried out at the same time the last sustain operation was carried out. However, the erase operation can be carried out using a lamp waveform.

In the above-mentioned embodiments, an object was a method of driving an AC plasma display panel for gray-scale display using a structure in which each field consists of eight subfields, each of which includes an initialization period, a write period, and a sustain period. Further, the above description was directed to a driving method in which at least a part of the sustain operation in each sustain period and a part of the initialization operation in the initialization period in each subsequent subfield were carried out at the same time in the seven subfields out of the eight subfields. However, it is possible to set freely the number of subfields included in one field, the number of subfields in which no erase period is provided, and the number of subfields in which the sustain operation at the last part of a sustain period and the initialization operation in the initialization period in the subsequent subfield are carried out at the same time. In addition, the driving waveform in the subfields is not limited. Moreover, the present invention can be applied to AC plasma display panels with other configurations.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of driving an AC plasma display panel having a substrate on which scanning electrodes and sustain electrodes are formed and another substrate on which data electrodes are formed, the two substrates being arranged opposing each other so as to form a plurality of discharge cells, the method comprising driving the discharge cells in accordance with a field that includes a plurality of subfields, whereby a gray-scale display is carried out, wherein each of the subfields comprises an initialization period, a write period and a sustain period;

in the initialization period, an initialization operation is carried out so that a voltage for causing initialization discharge is applied to the scanning electrodes and the sustain electrodes;

in the write period, a write operation is carried out so that a voltage for causing write discharge is applied, after the initialization period, to the data electrodes;

in the sustain period, a sustain operation is carried out so that a voltage for causing sustain discharge is applied, after the write period, to the scanning electrodes and the sustain electrodes; and at least in one predetermined subfield out of the plurality of subfields, the initialization operation is carried out simultaneously with the last part of the sustain operation in the preceding subfield so that the initialization discharge is caused only in the discharge cells that have been operated to emit light in the preceding subfield.

2. The method of driving an AC plasma display panel according to claim 1, wherein the initialization operation comprises a first initialization operation to be carried out at the same time with the last part of the sustain operation, and a second initialization operation to be carried out after the conclusion of the sustain discharge in the sustain period so that the second initialization operation functions as an erase operation for terminating a sustain discharge as well.

3. The method of driving an AC plasma display panel according to claim 1, wherein in the initialization period of a subfield subsequent to another subfield having the initialization period, the write period, and the sustain period, a voltage that is beyond a discharge starting voltage is applied between the data electrodes and the scanning electrodes simultaneously with the sustaining operation of the preceding subfield.

4. A method of driving an AC plasma display panel having a substrate on which scanning electrodes and sustain electrodes are formed and another substrate on which data electrodes are formed, the two substrates being arranged opposing each other so as to form a plurality of discharge cells, the method comprising driving the discharge cells in accordance with a field that includes a plurality of subfields, whereby a gray-scale display is carried out, wherein each of the subfields comprises an initialization period, a write period and a sustain period;

in the initialization period, an initialization operation is carried out so that a voltage for causing initialization discharge is applied to the scanning electrodes and the sustain electrodes;

in the write period, a write operation is carried out so that a voltage for causing write discharge is applied, after the initialization period, to the data electrodes;

in the sustain period, a sustain operation is carried out so that a voltage for causing sustain discharge is applied, after the write period, to the scanning electrodes and the sustain electrodes;

at least in one predetermined subfield out of the plurality of subfields, the initialization operation is carried out simultaneously with the last part of the sustain operation in the preceding subfield so that the initialization discharge is caused only in the discharge cells that have been operated to emit light in the preceding subfield; and in the initialization period, a positive voltage is applied to the sustain electrodes and a lamp voltage is applied to the scanning electrodes, the lamp voltage varying in such a manner that the voltage of the scanning electrodes with respect to the sustain electrodes varies from a voltage below the discharge starting voltage toward a voltage beyond the discharge starting voltage.

5. A method of driving an AC plasma display panel having a substrate on which scanning electrodes and sustain electrodes are formed and another substrate on which data electrodes are formed, the two substrates being arranged opposing each other so as to form a plurality of discharge cells, the method comprising driving the discharge cells in accordance with a field that cell includes a plurality of subfields, whereby a gray-scale display is carried out, wherein each of the subfields comprises an initialization period, a write period and a sustain period;

in the initialization period, an initialization operation is carried out so that a voltage for causing initialization discharge is applied to the scanning electrodes and the sustain electrodes;

in the write period, a write operation is carried out so that a voltage for causing write discharge is applied, after the initialization period, to the data electrodes;

in the sustain period, a sustain operation is carried out so that a voltage for causing sustain discharge is applied, after the write period, to the scanning electrodes and the sustain electrodes; and at least in one predetermined subfield out of the plurality of subfields, the initialization operation is carried out simultaneously with the sustain operation in the preceding subfield so that the initialization discharge is caused only in the discharge cells that have been operated to emit light in the preceding subfield.

6. The method of driving an AC plasma display panel according to claim 5, wherein in the sustain period of at least one predetermined subfield out of the plurality of subfields, a width of a last sustain pulse applied to the scanning electrodes or the sustain electrodes is set to be shorter than widths of the other sustain pulses, whereby an erase operation for terminating a sustain discharge is carried out simultaneously with the last sustain operation.

7. The method of driving an AC plasma display panel according to claim 5, wherein in the sustain period of the preceding subfield, a value at the lowest level of a sustain pulse voltage applied to the scanning electrodes and the sustain electrodes is set to be higher than that at the lowest level of a scan pulse voltage applied to the scanning electrodes in the write period, whereby the initialization operation in the predetermined subfield is carried out simultaneously with the sustain operation in the preceding subfield.

* * * * *